US007267163B2

(12) United States Patent
Osakabe et al.

(10) Patent No.: US 7,267,163 B2
(45) Date of Patent: Sep. 11, 2007

(54) HEAT EXCHANGER

(75) Inventors: Hiroyuki Osakabe, Chita-gun (JP); Takaki Okochi, Chiryu (JP); Toshihide Ninagawa, Ama-gun (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/134,875

(22) Filed: May 23, 2005

(65) Prior Publication Data

US 2005/0263270 A1 Dec. 1, 2005

(30) Foreign Application Priority Data

May 27, 2004 (JP) ..... 2004-158117

(51) Int. Cl.
*F28D 1/03* (2006.01)

(52) U.S. Cl. ..... 165/153; 165/166; 165/176

(58) Field of Classification Search ..... 165/152, 165/153, 166, 167, 176
See application file for complete search history.

(56) References Cited

U.S. PATENT DOCUMENTS 2,169,054 A * 8/1939 Mojonnier ..... 165/77
6,820,682 B2 11/2004 Hayashi et al.
2004/0177949 A1* 9/2004 Shimoya et al. ..... 165/152

FOREIGN PATENT DOCUMENTS

JP 2003-106794 4/2003
JP 2004-003802 1/2004

* cited by examiner

*Primary Examiner*—Teresa J. Walberg
(74) *Attorney, Agent, or Firm*—Harness, Dickey & Pierce, PLC

(57) ABSTRACT

A heat exchanger comprises: flat tubes laminated on each other, an external fluid flowing in a space formed between the flat tubes arranged adjacent to each other; and fins interposed between the flat tubes, the fins being formed into a protruding and recessing shape having a flat plate portion joined to an outer wall face of the tube when viewed in the flow direction of the external fluid and having a vertical plate portion crossing the flat plate portion, wherein heat is exchanged between the external fluid and the internal fluid flowing in the tubes, the flat plate portion including protruding portions arranged so the protruding portions is inclined in the flow direction of the external fluid, protrusions of the protruding portions being increased toward the downstream side of the external fluid, the vertical plate portion being formed so it meanders in the flow direction of the external fluid.

8 Claims, 9 Drawing Sheets

FLOW DIRECTION
13
11
9
7
5
3
0
(m/s)

FLOW DIRECTION
13
11
9
7
5
3
0
(m/s)

120
123
FLOW DIRECTION
13
11
9
7
5
3
0
(m/s)

HEAT EXCHANGER

BACKGROUND OF THE INVENTION

1. Field of the Invention

The present invention relates to a heat exchanger preferably used for exchanging heat between hot water to be supplied, which flows in tubes, and a combustion gas which flows in a fin region interposed between the tubes.

2. Description of the Related Art

Concerning the conventional heat exchanger, for example, JP-A-2003-106794 discloses a well known heat exchanger. This heat exchanger exchanges heat between the exhaust gas, which is discharged from an internal combustion engine, and the cooling water. In this heat exchanger, a plurality of wings (louvers, in this document) are provided in the exhaust gas flow direction on the inner wall side of the exhaust gas passage of the wave-shaped fins arranged in the exhaust gas passage.

Each wing is formed out of a face, the distance from the inner wall side of which is increased as it comes to the downstream side of the exhaust gas flow, arranged crossing the flow direction of the exhaust gas.

Due to the foregoing, vertical vortexes are formed when the exhaust gas moves over the wings. The vertical vortexes are drawn onto the inner wall side on the downstream side by a pressure difference between the side of the wing on the upstream side and the side of the wing on the downstream side. At the same time, the vertical vortexes are accelerated. Further, the exhaust gas passing in a gap, which is formed between the vertical plate section of the fins crossing the inner wall and the wings, is also accelerated by the vertical vortexes. Therefore, the heat transfer coefficient on the exhaust gas side can be enhanced and, further, an unburned substance, such as soot, attached to the fins can be blown away. Accordingly, while the fins are being prevented from clogging, the heat exchanging efficiency can be enhanced.

However, when the distribution of the flow velocity was analyzed in detail in the entire fin region in which a plurality of wings were arranged, the following results were obtained. In the heat exchanger of the present invention described later, as shown in FIG. 8, on the upstream side of the external fluid (combustion gas), it was possible to confirm the effect of the wings 123. However, as it came to the downstream side, the external fluid flowed being separated from the wing 123, and the generation of the vertical vortexes was attenuated and the flow velocity was lowered in the wing portions 123. Investigations were also made into the heat flux as follows. As shown in FIG. 9, the same result as that of the above flow velocity distribution was obtained. That is, it was found that a sufficiently high effect of the wings 123 was not obtained. In this connection, FIGS. 8A to 8D are views respectively showing the flow velocity distributions (The flow velocity on the flow-in side is 7 m/s.) in the root portion, the middle portion and the forward end portion of the wings 123 and also showing the flow velocity distribution of the middle portion of the fin 120. FIG. 9A is a view showing a heat flux distribution on the left of the vertical plate portion 122 of the fin 120 in FIG. 9B, FIG. 9B is a view showing a heat flux distribution on the flat plate portion 121 on the inner wall side of the fin 120, and FIG. 9C is a view showing a heat flux distribution on the right of the vertical plate portion 122 of the fin 120 in FIG. 9B.

SUMMARY OF THE INVENTION

The present invention has been achieved in view of the above problems. It is an object of the present invention to provide a heat exchanger capable of enhancing the heat exchanging performance by effectively generating vertical vortexes all over the region from the upstream side to the downstream side of the external fluid.

In order to accomplished the above object, the present invention adopts the following technical means.

According to a first aspect of the present invention, there is provided a heat exchanger comprising: a plurality of flat tubes (110) laminated on each other, an external fluid flowing in a space formed between the flat tubes (110) arranged adjacent to each other; and fins (120) interposed between the plurality of flat tubes (110), the fins (120) being formed into a protruding and recessing shape having a flat plate portion (121) joined to an outer wall face (110*a*) of the tube (110) when it is viewed in the flow direction of the external fluid and also having a vertical plate portion (122) crossing the flat plate portion (121), wherein heat is exchanged between the external fluid and the internal fluid flowing in the tubes (110), the flat plate portion (121) including a plurality of protruding portions (123) arranged so that the protruding portions (123) can be inclined in the flow direction of the external fluid, protrusions of the protruding portions (123) themselves being increased toward the downstream side of the external fluid, the vertical plate portion (122) being formed so that it can meander in the flow direction of the external fluid.

Due to the foregoing, vertical vortexes are formed in the external fluid by the protrusions (123), and the external fluid is accelerated. When the external fluid collides with the meandering vertical plate portion (122), the flow of the external fluid can be pushed back to the protrusion (123) side. Therefore, vertical vortexes can be repeatedly formed by the protrusions (123) all over the region from the upstream side to the downstream side of the external fluid. Accordingly, the heat exchanging performance can be enhanced.

In this connection, the second aspect of the present invention is preferably applied to a heat exchanger in which the external fluid is gas of high temperature containing steam, the internal fluid is fluid of low temperature, the temperature of which is lower than that of the gas of high temperature, and the fluid of low temperature is heated by recovering not only sensible heat from the gas of high temperature but also latent heat of condensation. Condensed water generated from the gas of high temperature at the time of heat exchange can be effectively discharged from the fins (120) by the action of the vertical vortexes (The flow velocity is increased.) generated in the gas of high temperature. Accordingly, it is possible to prevent the heat exchanging performance from deteriorating.

Incidentally, the reference numerals in parentheses, to denote the above means, are intended to show the relationship of the specific means which will be described later in an embodiment of the invention.

The present invention may be more fully understood from the description of preferred embodiments of the invention set forth below, together with the accompanying drawings.

DESCRIPTION OF PREFERRED EMBODIMENTS

Figure 1:
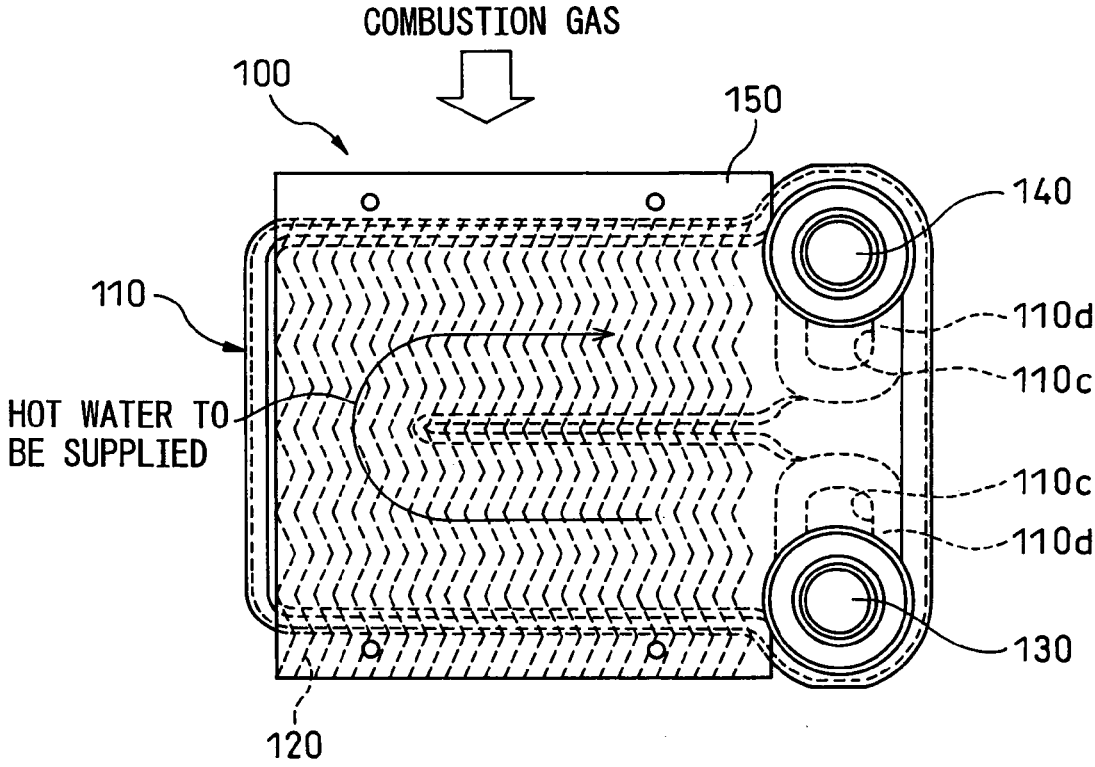
FIG. 1 is a front view showing a heat exchanger of the first embodiment.
Figure 2:
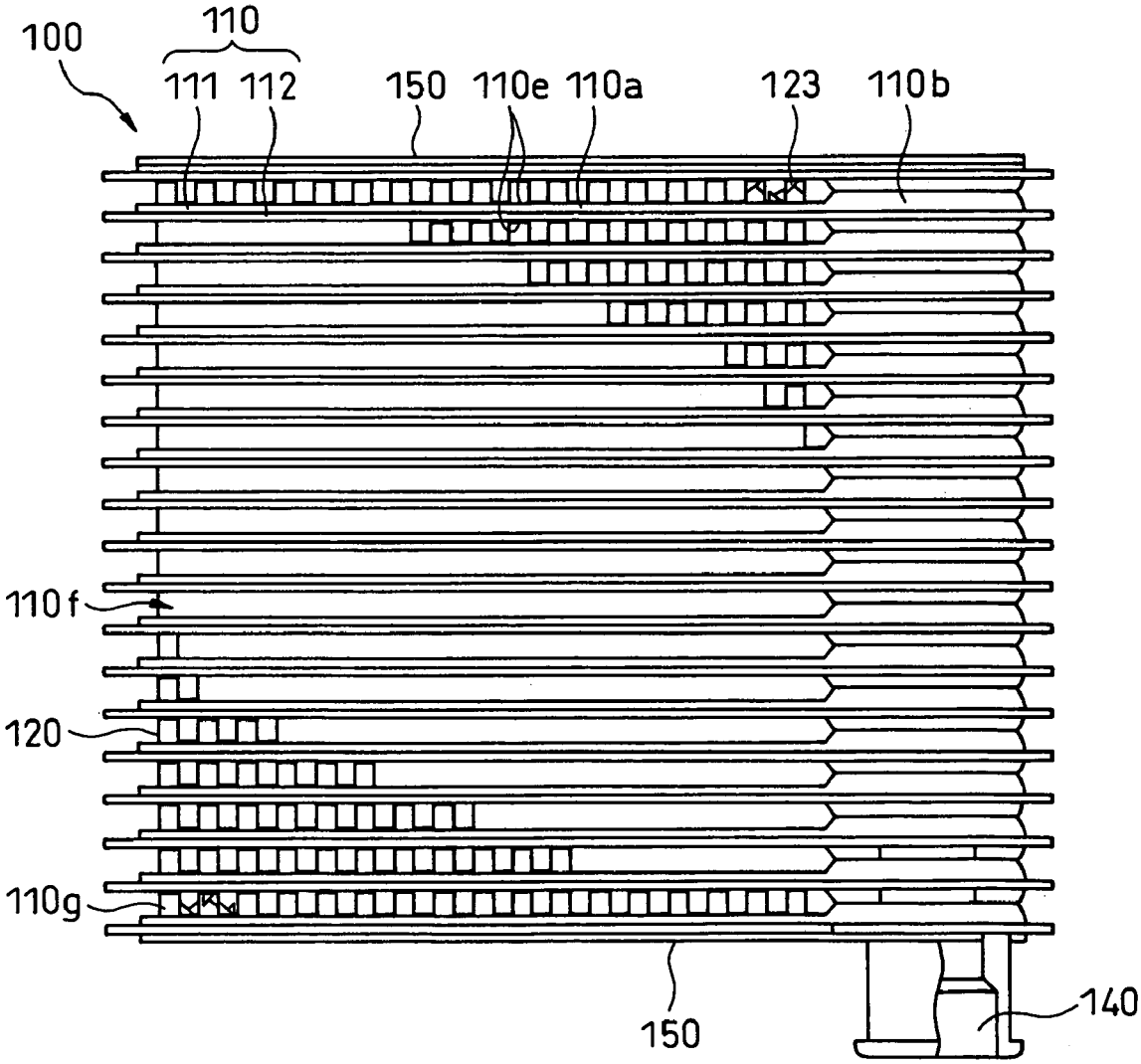
FIG. 2 is a plan view showing a heat exchanger of the first embodiment.
Figure 3:
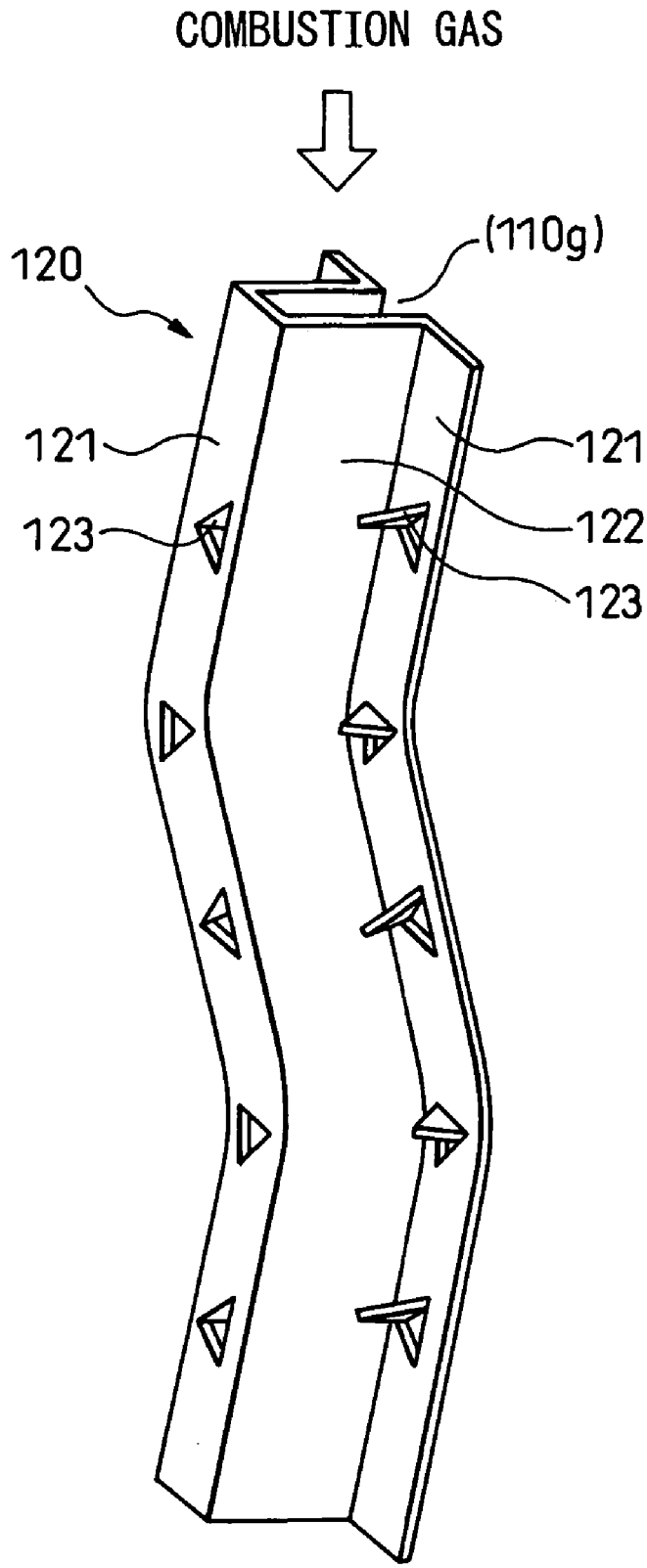
FIG. 3 is a perspective view showing appearance of an outer fin.

First of all, the first embodiment will be explained below. Referring to FIGS. 1 to 3, the first embodiment of the present invention is explained as follows. In this connection, FIG. 1 is a front view showing a heat exchanger 100, FIG. 2 is a plan view showing the heat exchanger 100, and FIG. 3 is a perspective view showing appearance of the outer fin 120.

In the heat exchanger 100 of this embodiment, heat is exchanged between the hot water (corresponding to the internal fluid and the fluid of low temperature of the present invention) to be supplied which is used for a hot water supply unit and the combustion gas containing steam (corresponding to the external fluid and the gas of high temperature). Of course, the temperature of the hot water is lower than that of the combustion gas, and the hot water is heated by the combustion gas. As shown in FIGS. 1 and 2, this heat exchanger 100 is of the drawn cup type in which a plurality of flat tubes 110 are laminated on each other together with the outer fins 120. After all the components have been assembled to each other, the entire body is soldered into one body.

The tube 110 is composed of two tube plates 111, 112 which are combined with each other. The tube 110 includes: a flat tube portion 110*a* in which a U-shaped water passage is formed; and a set of tank portions 110*b* which are communicated with both end portions of the water passage. The communicating port 110*c* is open to this tank portion 110*b*.

A winding and fastening portion (not shown) is provided in the periphery of one tube plate 111. The two tube plates 111, 112 are assembled by being wound and fastened in such a manner that the winding and fastening portion of one tube plate 111 is folded back from the inside to the outside of the other tube plate 112 and wound and fastened so that the end portions of the other tube plate 112 can be pinched from both sides, and then the contact face between both members is soldered.

The tank portion 110*b* is provided in such a manner that the thickness and width of the tank portion 110*b* are larger than those of the flat tube portion 110*a*. On the outer wall face of the tube plate 111, 112 composing the tank portion 110*b*, the flat face 110*d*, which becomes a soldered face, is annularly arranged round the communicating port 110*c*.

A plurality of tubes 110 are laminated on each other so that the respective tank portions 110*b* can be contacted with each other, and the flat portions 110*d* provided round the communicating port 110*b* are joined to each other. Due to the foregoing, the water passages of the tubes 110 are communicated with each other via the communicating ports 110*c* which are open to the tank portions 110*b*. In this connection, in order to increase the heating surface area, inner fins (not shown) may be inserted into the tubes 110.

Concerning the tube 110 arranged on one end side in the laminating direction, the hot water supply port 130 and the hot water discharge port 140 are joined to the tank portion 110*b*. The reinforcing plates 150 are respectively joined to both end sides of the tube 110 in the laminating direction.

Concerning the flat tube portion 110*a*, the thickness and width of which are smaller than those of the tank portion 110*b*, a flat space, the width of which is substantially constant, is formed between the flat tube portions 110*a* which are adjacent to each other. This space is a combustion gas passage 110*f* in which the combustion gas passes. In this combustion gas passage 110*f*, the outer fins (corresponding to the fins described in the present invention) 120 are arranged.

As shown in FIG. 3, the outer fins (referred to as fins hereinafter) 120 are made in such a manner that a sheet made of metal, the heat transmission property of which is high, is folded and formed into protruding and recessing portions. The fins 120 are arranged so that the combustion gas flows in the protruding and recessing spaces from the upper to the lower portion. These fins 120 are soldered onto the outer wall face 110*e* of the flat tube portion 110*a*. The combustion gas passage 110*f* is divided into a plurality of small passages 110*g* by the fins 120 which are folded into the protruding and recessing shape.

In this connection, among the wall faces of the fin 120 folded into the protruding and recessing shape, the wall face, which is arranged in parallel with the outer wall face 110*e* of the tube 110 and soldered to this outer wall face 110*e*, is a flat plate portion 121. Among the wall faces of the fin 120 folded into the protruding and recessing shape, the side wall face, which crosses the flat plate portion 121, is a vertical plate portion 122.

In the flat plate portion 121 of the fin 120, in almost all regions of the fin 120 arranged in the combustion gas passage 110*f*, a plurality of rising pieces (referred to as wings hereinafter) 123 are dispersedly provided at predetermined intervals.

In this case, the wing 123 is formed in such a manner that a triangular portion, except for one side of the triangle, is raised from the flat plate portion 121 of the fin 120. Therefore, the wing 123 composes a protruding portion which protrudes into the combustion gas passage 110*f*. In this connection, the wing 123 is arranged so that the height (the protrusion) from the flat plate portion 121 can be increased toward the downstream side of the combustion gas flow.

The wing 123 is arranged so that it can be inclined by a predetermined angle with respect to the direction of the combustion gas flow. Two wings 123, which continue to each other in the vertical direction of the fin 120, are raised so that the inclination angles with respect to the direction of the combustion gas flow can be different from each other. In other words, the wings 123 are arranged zigzag in such a manner that the inclination angles are different from each other with respect to the combustion gas flow. In this connection, the height and width of the wing 123 are determined at values so that a wing 123 cannot close each combustion gas passage.

Further, the vertical plate section 122 of the fin 120 is formed so that it can meander in the combustion gas flow direction. In this connection, the flat plate portion 121 is formed into a meandering shape in which the flat plate portion 121 is arranged along the vertical plate portion 122. Generally, the small passage 110*g* is formed into a meandering passage.

Next, the operation and the operational effect of this embodiment will be explained below. Hot water to be supplied flows from the hot water supply port 130 of the heat exchanger 100 into the tank portion 110*b* of each tube 110 and flows from one tank portion 110*b* into the water passage, which is formed in the flat tube portion 110*a*, and then flows out from the other tank portion 110*b* passing through the hot water discharge port 140. On the other hand, as shown in FIG. 1, the combustion gas flows from an upper portion of the heat exchanger 100 to a lower portion. In this case, the temperature on the upstream side is approximately 200° C. When the combustion gas passes through the heat exchanger 100, heat is exchanged between the combustion gas and the hot water to be supplied, so that the hot water to be supplied can be heated. At this time, on the discharge port side of the heat exchanger 100, the temperature of the combustion gas is lowered to a value (for example, 30 to 50° C.) not higher than the dew point. Therefore, steam contained in the combustion gas is condensed. That is, this heat exchanger 100 can heat the hot water to be supplied when the heat exchanger 100 absorbs not only the sensible heat of the combustion gas but also the latent heat of condensation which is emitted when the combustion gas is condensed.

In this case, when the combustion gas flows in the small passage 110*g*, a vertical vortex is formed in the combustion gas by the wing 123 or the combustion gas is accelerated. When the combustion gas collides with the meandering vertical plate portion 122, the combustion gas can be pushed back toward the wing 123 side. Therefore, all over the entire range from the upstream side to the downstream side of the combustion gas, vertical vortexes can be repeatedly formed by the wings 123, and the heat exchanging performance can be enhanced.

Condensed water generated from the combustion gas at the time of heat exchange can be effectively discharged from the fins 120 by the effects of the vertical vortexes (an increase in the flow velocity) generated in the combustion gas. Accordingly, it is possible to prevent the heat exchanging performance from being deteriorated by the condensed water.

Figures 4A, 4B, 4C, 4D:
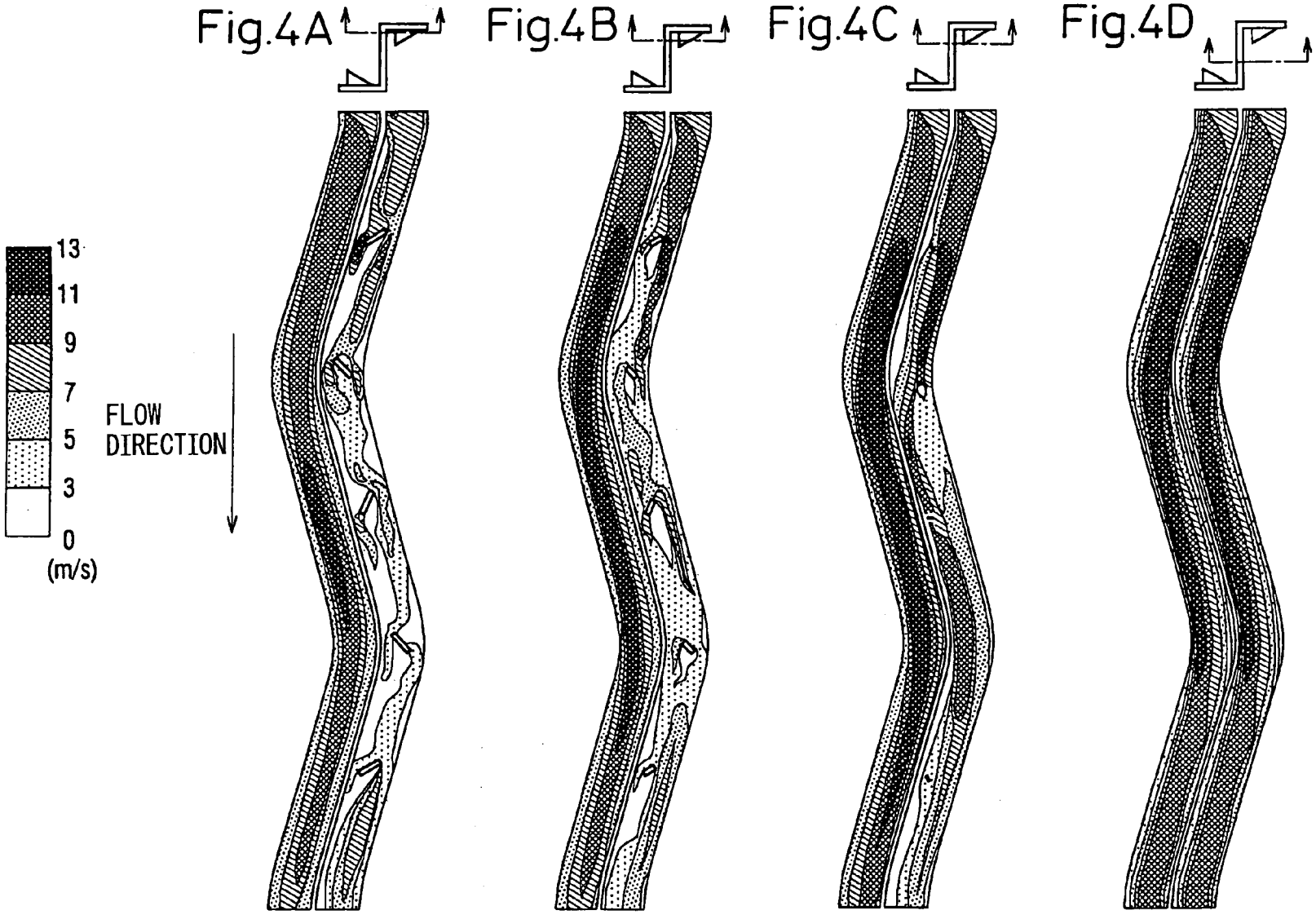
FIGS. 4A to 4D are velocity distribution charts respectively showing a distribution of flow velocity of the combustion gas in the first embodiment.
Figures 5A, 5B, 5C:
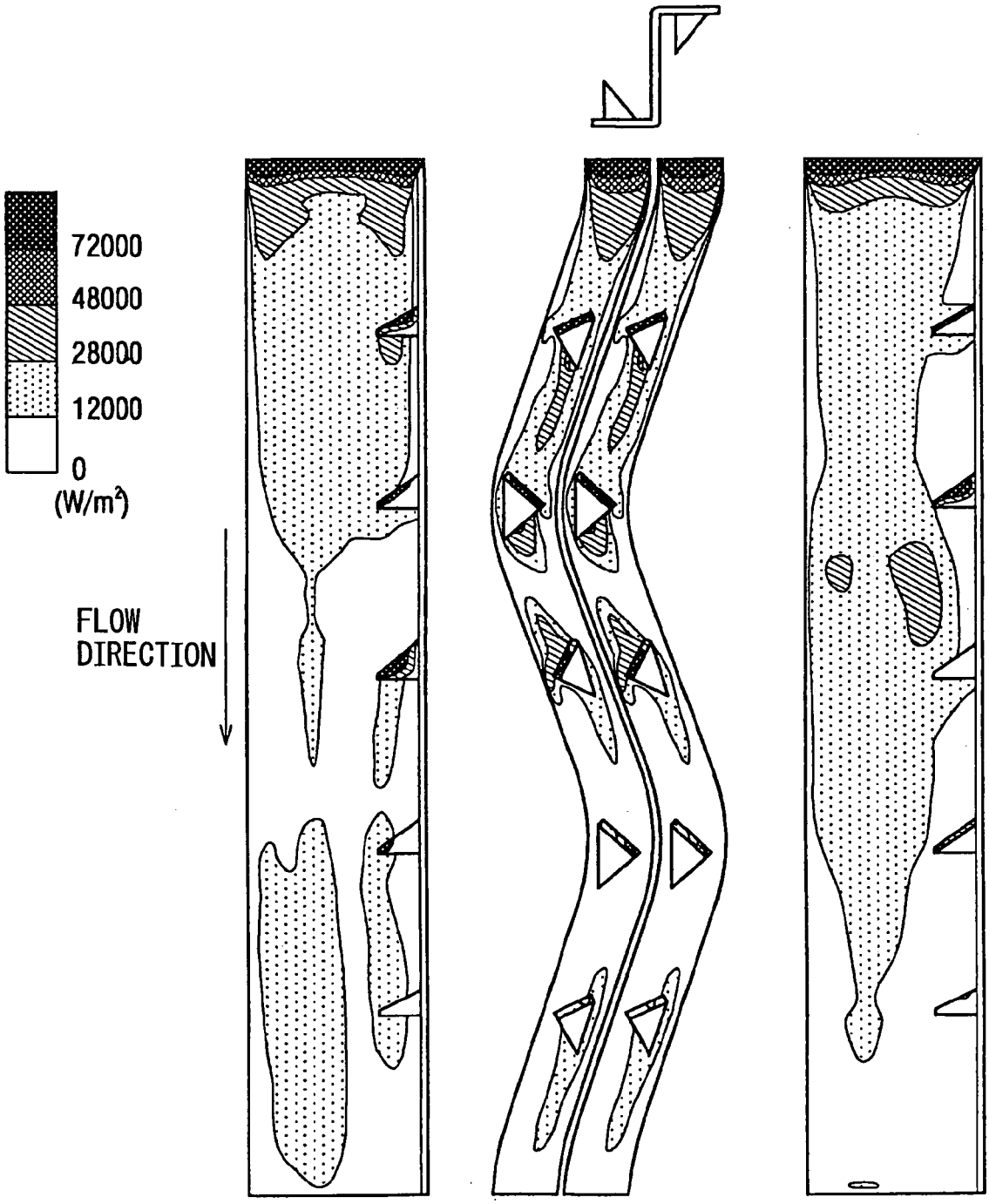
FIGS. 5A to 5C are heat flux distribution charts respectively showing a distribution of heat fluxes on a fin surface in the first embodiment.
Figures 8A, 8B, 8C, 8D:
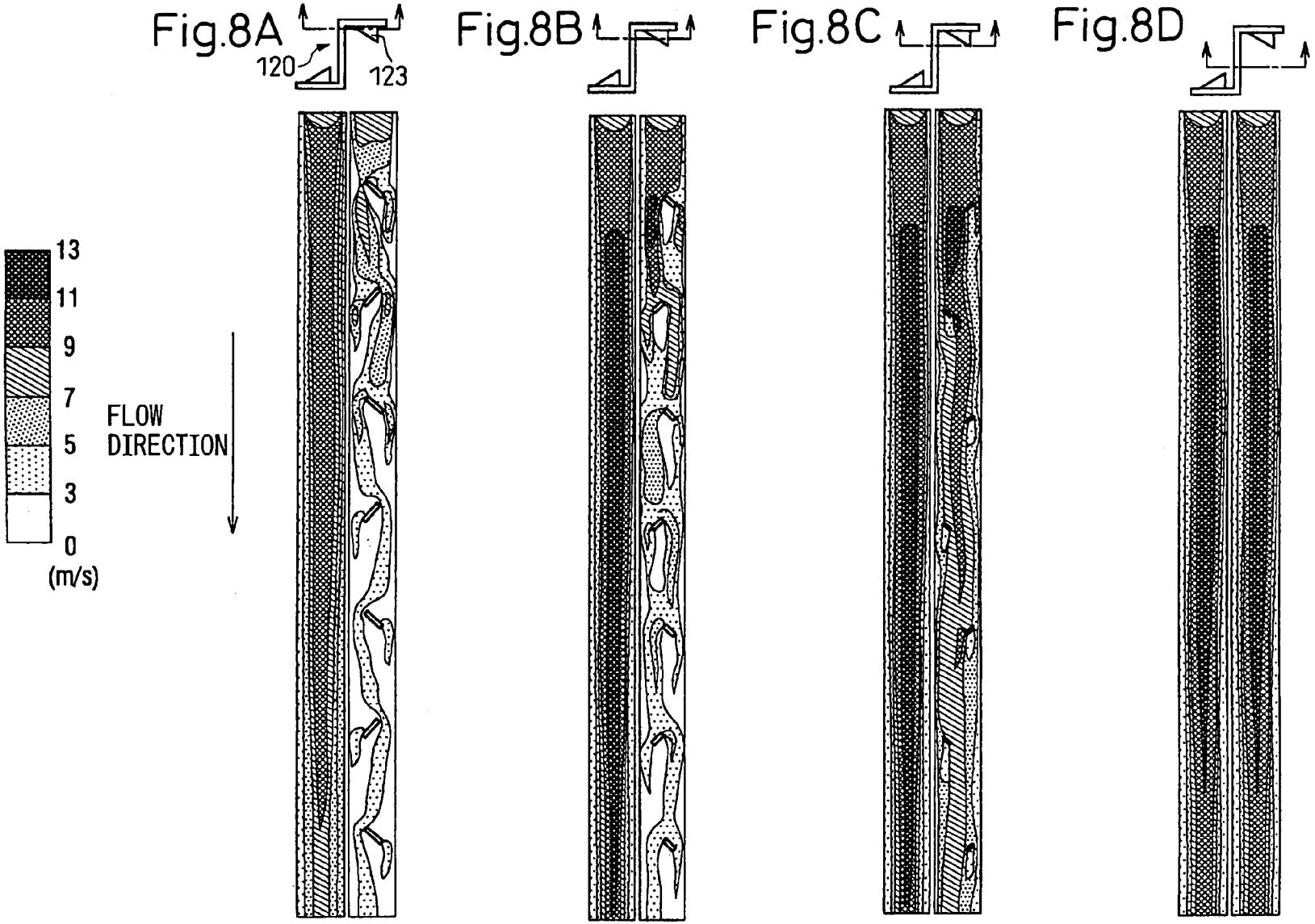
FIGS. 8A to 8D are flow velocity distribution charts respectively showing a distribution of the flow velocity of the combustion gas in the prior art.
Figures 9A, 9B, 9C:
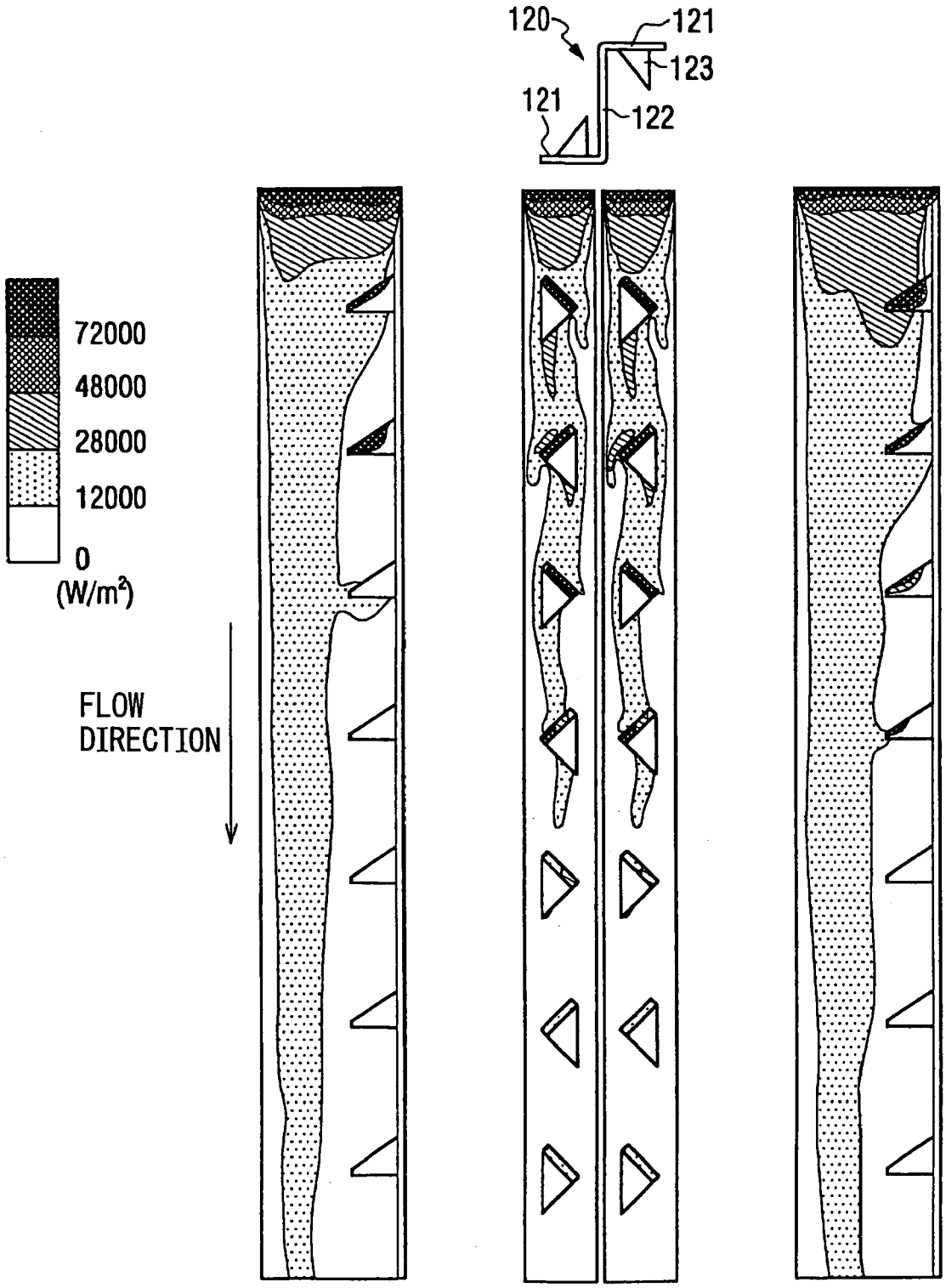
FIGS. 9A to 9C are heat flux distribution charts respectively showing a distribution of heat fluxes on a fin surface in the prior art.

In this connection, FIG. 4 is a view showing a flow velocity distribution of the combustion gas in this embodiment. FIG. 5 is a view showing a heat flux distribution in this embodiment. The portion to be measured and the condition of the measurement are the same as those of FIG. 8 and FIG. 9 (the prior art). In this embodiment, the following was confirmed. As compared with the prior art, by the meandering vertical plate section 122 in addition to the wings 123, the vertical vortexes were effectively formed even on the downstream side, and the flow velocity and the heat flux were enhanced.

In this embodiment, a quantity of heat exchanged in the heat exchanger 100 was confirmed as follows. It was confirmed that the quantity of heat exchanged in the heat exchanger 100 was enhanced by 6% with respect to the prior art. This confirmation was made at the time when the upstream side combustion gas flow rate was 7 m/s. In this connection, it was confirmed that the quantity of heat exchanged in the heat exchanger 100 was enhanced by 8% even in the low flow rate region (the flow rate: 3.5 m/s) of the combustion gas.

Figures 6A, 6B, 6C, 6D:
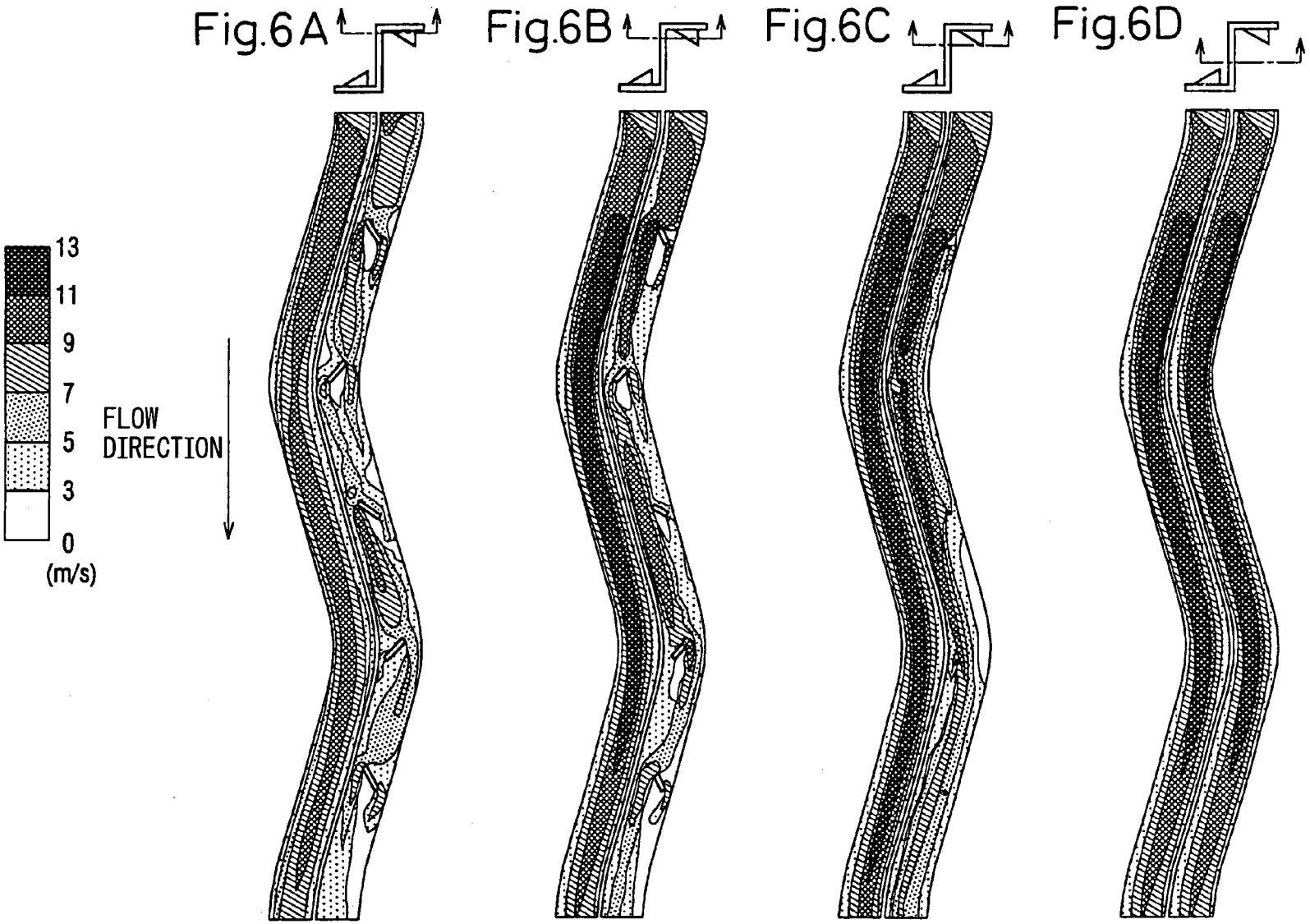
FIGS. 6A to 6D are flow velocity distribution charts respectively showing a distribution of flow velocity of the combustion gas in another embodiment.
Figures 7A, 7B, 7C:
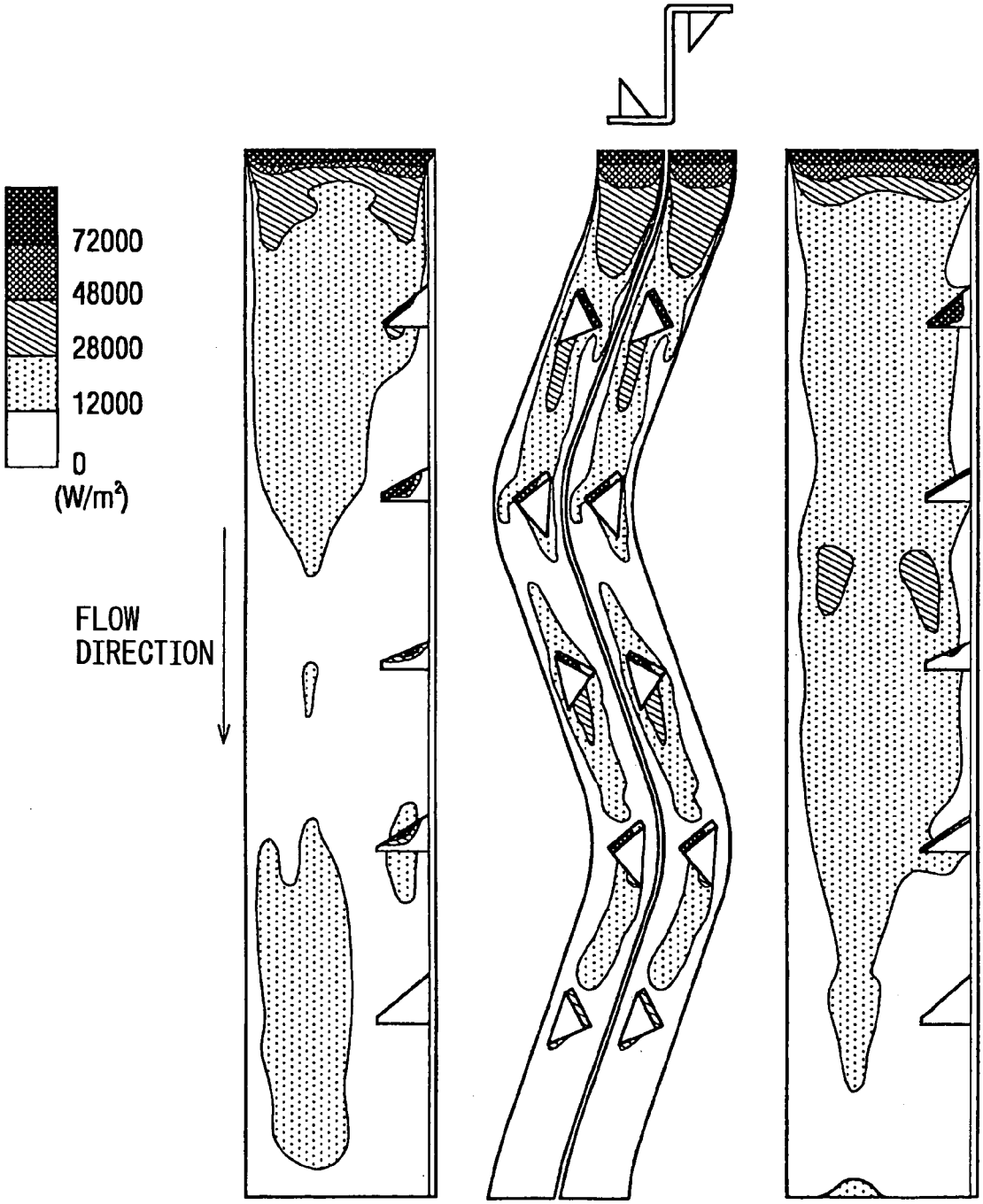
FIGS. 7A to 7C are heat flux distribution charts respectively showing a distribution of heat fluxes on a fin surface in another embodiment.

Finally, another embodiment will be explained below. The direction of the inclination of the wing 123 with respect to the flow direction of the combustion gas may be reverse to that of the first embodiment. In this case, the same effect as that of the first embodiment can be obtained as shown in FIGS. 6 and 7.

In the embodiment explained above, the fin 120 is formed into a shape which is bent into a rectangular shape as shown in FIG. 3. However, as long as the fin 120 has a sufficiently large flat plate portion 121 for forming the wing 123, any shape of the fin 120 can be employed. A fin, the folded portion of which is formed so that it can have an R-shaped portion, may be employed.

On the wall face of the tube 110 opposed to the flat plate portion 121 on which the wing 123 is formed, a protruding and recessing portion, which protrudes into the combustion gas passage 110*f*, may be formed, for example, by means of embossing.

The objective heat exchanger is not limited to the above heat exchanger 100 used for hot-water-supply units. The present invention can be applied to radiators and evaporators other than the hot-water-supply units.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A heat exchanger comprising:

a plurality of flat tubes laminated on each other, an external fluid flowing in a space formed between adjacent flat tubes; and fins interposed between the plurality of flat tubes, each of the fins being formed into a protruding and recessing shape having a flat plate portion joined to an outer wall face of the tube when it is viewed in a flow direction of the external fluid and a vertical plate portion crossing the flat plate portion, wherein heat is exchanged between the external fluid and an internal fluid flowing in the tubes, the flat plate portion includes a plurality of protruding portions arranged so that the protruding portions are inclined in the flow direction of the external fluid, protrusions of the protruding portions being increased toward a downstream side of the external fluid, the vertical plate portion meanders in the flow direction of the external fluid;

a first protrusion which is located on a downstream side of a second protrusion in the flow direction of the external fluid has a height measured from the flat plate portion that is larger than a height of the second protrusion measured from the flat plate portion; and a connecting portion which connects the vertical plate portion with the flat plate portion meanders.

2. A heat exchanger according to claim 1, wherein the external fluid is a high temperature gas containing steam, the internal fluid is a low temperature fluid having a temperature which is lower than a temperature of the high temperature gas, and the sensible heat and the latent heat of condensation are recovered from the high temperature gas to heat the low temperature fluid.

3. A heat exchanger according to claim 1, wherein connecting portions, each of which connects a respective protrusion with the flat plate portion, are tilted with respect to the flow direction of the external fluid.

4. A heat exchanger according to claim 1, wherein each of the flat plate portions are joined directly to the outer wall face of the tube.

5. A heat exchanger according to claim 1, wherein apertures are defined by the flat plate portions, each aperture being disposed adjacent a respective protruding portion, each aperture being closed by the outer wall face of the tube.

6. A heat exchanger comprising:

a plurality of flat tubes laminated on each other, an external fluid flowing in a space formed between adjacent flat tubes; and fins interposed between the plurality of flat tubes, each of the fins having a flat plate portion joined directly to an outer wall face of the tube and a vertical plate portion crossing the flat plate portion, wherein heat is exchanged between the external fluid and an internal fluid flowing in the tubes, the flat plate portion defines a plurality of protruding portions inclined in a flow direction of the external fluid, a height of the protruding portions varying in the flow direction of the external fluid, and the vertical plate portion meanders in the flow direction of the external fluid.

7. A heat exchanger comprising:

a plurality of flat tubes, adjacent flat tubes defining a space for accommodating flow of an external fluid;

a plurality of fins disposed in the space, each fin having a first flat portion attached directly to an outer wall face of one of the adjacent flat tubes, a second flat face attached directly to an outer wall face of the other of the adjacent flat tubes and a plate portion extending between the first and second flat faces; and a first plurality of protruding portions extending from the first flat face, the first plurality of protruding portions being inclined in a flow direction of the external fluid; wherein heat is exchanged between the external fluid and an internal fluid flowing in the flat tubes;

a height of the first plurality of protruding portions varying in the flow direction of the external fluid; and the plate portion meanders in the flow direction of the external fluid.

8. The heat exchanger according to claim 7, further comprising:

a second plurality of protruding portions extending from the second flat face, the second plurality of protruding portions being inclined in the flow direction of the external fluid.

* * * * *